US009008557B2

(12) United States Patent
Cho

(10) Patent No.: US 9,008,557 B2
(45) Date of Patent: Apr. 14, 2015

(54) IMAGE FORMING APPARATUS TO FORM AN AUTO COLOR REGISTRATION PATTERN AND CONTROL METHOD THEREOF

(71) Applicant: Samsung Electronics Co., Ltd., Suwon (KR)

(72) Inventor: Hyun Ki Cho, Hanam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 153 days.

(21) Appl. No.: 13/745,141

(22) Filed: Jan. 18, 2013

(65) Prior Publication Data

US 2013/0189000 A1 Jul. 25, 2013

(30) Foreign Application Priority Data

Jan. 20, 2012 (KR) ..... 10-2012-0006656

(51) Int. Cl.
*G03G 15/01* (2006.01)
*G03G 15/00* (2006.01)
*G03G 13/01* (2006.01)

(52) U.S. Cl.
CPC ..... *G03G 15/0126* (2013.01); *G03G 15/5058* (2013.01); *G03G 13/01* (2013.01); *G03G 2215/0161* (2013.01)

(58) Field of Classification Search
CPC ..... G03G 15/5058; G03G 13/01; G03G 2215/0161
USPC ..... 399/301, 72, 49; 347/116
See application file for complete search history.

(56) References Cited

U.S. PATENT DOCUMENTS

| | | | | |
|---|---|---|---|---|
| 5,825,984 | A * | 10/1998 | Mori et al. | |
| 5,995,802 | A * | 11/1999 | Mori et al. | 347/116 |
| 7,636,533 | B2 * | 12/2009 | Kikuchi et al. | 399/301 |
| 2010/0178084 | A1 * | 7/2010 | Kang et al. | 399/301 |
| 2011/0097119 | A1 * | 4/2011 | Cho et al. | 399/301 |

FOREIGN PATENT DOCUMENTS

| | | | |
|---|---|---|---|
| JP | 2000250284 | A * | 9/2000 |
| JP | 2007232763 | A * | 9/2007 |

* cited by examiner

*Primary Examiner* — Susan Lee
(74) *Attorney, Agent, or Firm* — Staas & Halsey LLP

(57) ABSTRACT

An image forming apparatus and a control method enhancing ACR (Auto Color Registration) performance by optimizing ACR patterns are provided. The apparatus includes a photosensitive drum, an exposure unit to radiate the drum to form an latent image, a developing unit supplying color toner corresponding to the latent image, and a transfer belt to which the toner image is transferred. A pattern generating unit forms a latent image corresponding to a predetermined ACR pattern on the drum to form the ACR pattern on the transfer belt, and allowing amounts of gap changes of sub patterns, which form the ACR pattern, to have an average value of about 0, the gap change of sub patterns caused by an AC component generated from a rotation of the drum. A pattern detecting unit detects a pattern formed on the transfer belt, and an ACR executing unit calculates offsets to correct errors.

14 Claims, 14 Drawing Sheets

IMAGE FORMING APPARATUS TO FORM AN AUTO COLOR REGISTRATION PATTERN AND CONTROL METHOD THEREOF

CROSS-REFERENCE TO RELATED APPLICATIONS

This application is related to, and claims priority to, Korean Patent Application No. 10-2012-0006656, filed on Jan. 20, 2012, in the Korean Intellectual Property Office, the disclosure of which is incorporated herein by reference.

BACKGROUND

1. Field

Embodiments of the present disclosure relate to an image forming apparatus configured to form a color image through a single pass scheme, and a control method thereof.

2. Description of the Related Art

An image forming apparatus using an electro-photographic scheme such as a laser printer and a digital copier may be defined as an apparatus configured to radiate light on a photosensitive medium that is charged with a predetermined electric potential to form an electrostatic latent image on the photosensitive medium. After developing the electrostatic latent image to a visible image by supplying a toner, that is, a developing agent, to the electrostatic latent image, the visible image may be transferred and fixed to a paper, thereby achieving an image printing. A color image forming apparatus of an electro-photographic scheme may be configured to supply the toners having four types of colors, which are black 'K' (black), yellow 'Y' (Yellow), magenta 'M' (Magenta), and cyan 'C' (Cyan), to the photosensitive medium to form images having different colors to each other. By overlapping the images, a color image is produced.

At the color image forming apparatus, when the images having different colors to each other are overlapped, if the image of each different color is not overlapped at a correct position, the border portion of the image may appear blurry, and thus the quality of the image may be poor. This may occur as a result of a number of variable factors, such as a replacement of a developer or an increase in the number of prints. Thus, a color registration task, which is configured to align the images that are provided with different colors to each other, so that the images are overlapped at correct positions, is needed.

A color image forming apparatus of a single pass scheme may use four exposure units and four photosensitive drums. When a number of variable factors, such as a replacement of a developer or an increase in the number of prints occurs, the apparatus may be configured to perform an ACR (Auto Color Registration) to automatically perform a color registration. Thus, high-quality color images may be produced.

To enhance the performance of the ACR, in general, a method of increasing the number of ACR patterns is applied. But, when the number of the ACR patterns is increased, the performing time of the ACR may be increased. To increase the number of the ACR patterns, if the patterns are formed in an adjacent manner on the intermediate transfer belt, a possibility of the patterns being detected by a sensor while being mixed with the noise component generated by the scratch or the punching of the intermediate transfer belt may be increased. Thus a prediction of a correction value of the ACR may be less accurate, thereby reducing the performance of the ACR.

With respect to a process of transferring the ACR patterns from the photosensitive drum to the intermediate transfer belt, a periodic change of a linear speed by a rotation of the photosensitive drum generates an (Alternating Current) AC component, and thereby the accurate DC offset value may be difficult to determine.

SUMMARY

It is an aspect of the present disclosure to provide an image forming apparatus and a control method thereof configured to enhance an ACR performance by optimizing the arrangement of the ACR patterns without a change of the structural configuration of the image forming apparatus or an increase of the number of the ACR patterns.

It is an aspect of the present disclosure to provide an image forming apparatus and a control method thereof capable of obtaining an accurate DC offset value of each color by arranging the ACR patterns while considering the AC component caused by a periodic change of the linear speed generated from the rotation of the photosensitive drum, thereby effectively enhancing the color registration error.

Additional aspects of the disclosure will be set forth in part in the description which follows and, in part, will be obvious from the description, or may be learned by practice of the disclosure.

In accordance with an aspect of the present disclosure, an image forming apparatus of a single pass scheme comprising a photosensitive drum having an outer circumferential surface on which an electrostatic latent image is formed, an exposure unit configured to radiate light at the photosensitive drum to form the electrostatic latent image on the outer circumferential surface of the photosensitive drum, a developing unit configured to form a toner image by supplying a color toner that corresponds to the electrostatic latent image formed on the outer circumferential surface of the photosensitive drum, and an intermediate transfer belt to which the toner image formed at the outer circumferential surface of the photosensitive drum is transferred The image forming apparatus includes a pattern generating unit, a pattern detecting unit and an ACR executing unit. The pattern generating unit may be configured to form an electrostatic latent image corresponding to a predetermined ACR (Auto Color Registration) pattern on the outer circumferential surface of the photosensitive drum to form the ACR pattern on the intermediate transfer belt, the pattern generating unit allowing amounts of gap changes of a plurality of sub patterns, which forms the ACR pattern, to have an average value of about 0, the gap change of the plurality of sub patterns caused by an AC component generated from a rotation of the photosensitive drum. The pattern detecting unit may be configured to detect the ACR pattern that is formed on the intermediate transfer belt. The ACR executing unit may be configured to calculate an offset of each color based on the detection result of the pattern detecting unit, and to correct a color registration error by use of the offset calculated.

The pattern generating unit may be configured in a way that the plurality of sub patterns forming the ACR pattern includes main-scan direction patterns and sub-scan direction patterns that are provided in different forms from the main-scan direction patterns. The pattern generating unit may be configured to allow an average value of amounts of gap changes of the main-scan direction patterns and an average value of amounts of gap changes of the sub-scan direction patterns to be about 0.

The pattern generating unit may allow the ACR pattern to have a length that is an integer multiple of a circumferential length of the photosensitive drum.

The pattern generating unit may allow the main-scan direction patterns to be generated in a same number as the sub-scan direction patterns, the number being an integer equal to or larger than two.

The pattern generating unit may allow a pattern adjacent to a random pattern on an $M^{th}$ order in the ACR pattern to have a same shape as the random pattern.

The pattern generating unit may allow a gap between the random pattern and the pattern adjacent to the random pattern on the $M^{th}$ order to be half the circumferential length of the photosensitive drum.

The pattern generating unit may allow the sub-scan direction pattern to have a bar shape while allowing the main-scan direction pattern to have a slant pattern that is inclined with respect to the sub-scan direction pattern at a predetermined angle.

The predetermined angle may be greater than 0 degrees and less than 90 degrees.

In accordance with an aspect of the present disclosure, an image forming apparatus of a single pass scheme configured to form an ACR (Auto Color Registration) pattern is characterized as follows. The ACR pattern may include main-scan direction patterns and sub-scan direction patterns, which are provided in different shapes s from the main-scan direction patterns while provided in a same number as the main-scan direction patterns, within a period of an AC component of a photosensitive drum of the image forming apparatus, the number being an integer equal to or larger than two. A pattern adjacent to a random pattern on an $M^{th}$ order in the ACR pattern may have a same shape as the random pattern. A gap between the random pattern and the pattern adjacent to the random pattern on the $M^{th}$ order may be half a circumferential length of the photosensitive drum.

In accordance with an aspect of the present disclosure, a method of controlling an image forming apparatus configured to form an ACR (Auto Color Registration) pattern on an intermediate transfer belt, to calculate a color offset by detecting the ACR pattern, and to execute a color registration task based on the color offset calculated is characterized as follows. The ACR pattern may include a plurality of sub patterns. An average value of amounts of gap changes of the plurality of sub patterns caused by an AC component generated from a rotation of the photosensitive drum may be about 0.

The plurality of sub patterns forming the ACR pattern may include main-scan direction patterns and sub-scan direction patterns provided in different forms from the main-scan direction patterns. An average value of amounts of gap changes the main-scan direction patterns and an average value of amounts of gap changes of the sub-scan direction patterns may be about 0.

The main-scan direction patterns may be provided in a same number as the sub-scan direction patterns within a period of the AC component, the number being an integer equal to, or larger than, two.

A pattern adjacent to a random pattern on an $M^{th}$ order in the ACR pattern may have a same shape as the random pattern.

A gap between the random pattern and the pattern adjacent to random pattern on the $M^{th}$ order may have a value that is half a circumferential length of the photosensitive drum.

By optimizing the arrangement of ACR patterns, without a change of the structural configuration of the image forming apparatus or the increase of the number of the ACR patterns, the ACR performance may be enhanced.

By arranging the ACR patterns in consideration of the AC component that may be caused by a periodic change of the linear speed generated from the rotation of a photosensitive drum, the accurate DC offset value may be found, and through such, the color registration error may be effectively enhanced.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
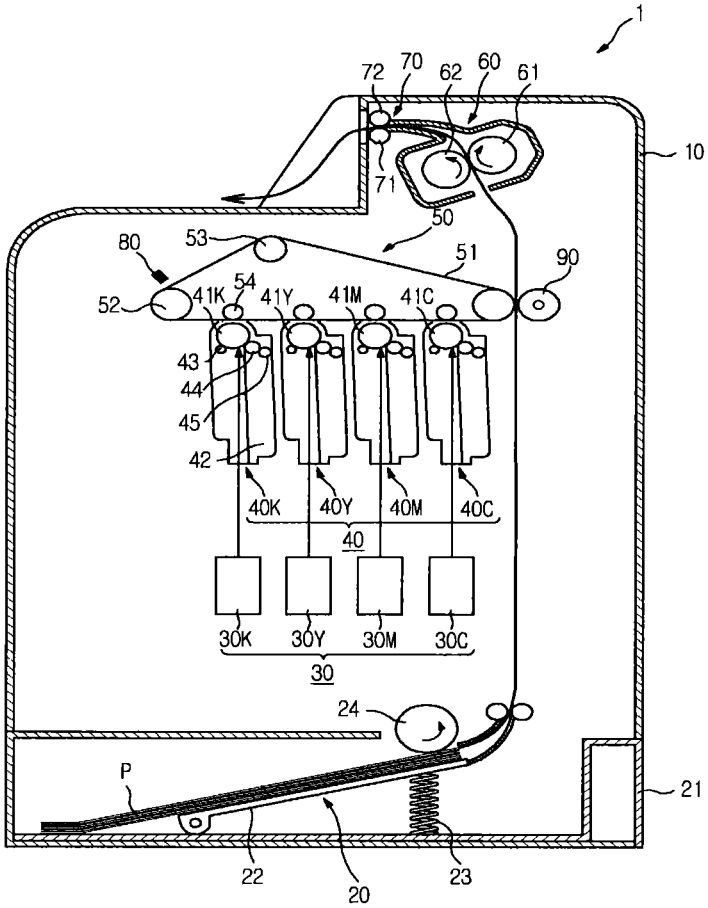
FIG. 1 illustrates an image forming apparatus in accordance with an embodiment of the present disclosure.

Reference will now be made in detail to the embodiments of the present disclosure, examples of which are illustrated in the accompanying drawings, wherein like reference numerals refer to like elements throughout.

FIG. 1 illustrates an image forming apparatus in accordance with an embodiment of the present disclosure.

In an exemplary embodiment of the present disclosure, an image forming apparatus configured to form a color image using a single pass scheme may be used.

Referring to FIG. 1, an image forming apparatus 1 of a single pass scheme in accordance with an embodiment of the present disclosure includes a paper feeding unit 20, a exposure unit 30, a developing unit 40, a intermediate transfer unit 50, a transferring unit 90, a fixing unit 60, a paper discharging unit 70, and a pattern detecting unit 80 inside a body 10 that forms an exterior appearance of the image forming apparatus 1.

The paper feeding unit 20 includes a paper feeding cassette 21 coupled to a lower portion of the body 10 in a attachable/ detachable manner, a paper pressing panel 22 installed inside the paper feeding cassette 21 in a rotatively movable manner in vertical directions, an elastic member 23 provided at a lower portion of the paper pressing panel 22 to elastically support the paper pressing panel 22, and a pick-up roller 24 provided at a front end portion of a paper 'P' accumulated at the paper pressing unit 22 to pick up the paper 'P'.

The exposure unit 30 (30K, 30Y, 30M, and 30C) is configured to scan the light which corresponds to the image information of the color that is different to each other, such as black 'K', yellow 'Y', magenta 'M', or cyan 'C', to the developing unit 40, and may use a Laser Scanning Unit (LSU) that uses a laser diode as the light source.

The developing unit 40 includes four units of developers 40K, 40Y, 40M, and 40C in which the toners of the four different colors, for example, the black 'K', the yellow 'Y', the magenta 'M', and the cyan 'C', are accommodated respectively. At the developers 40K, 40Y, 40M, and 40C, photosensitive mediums 41K, 41Y, 41M, and 41C, on which an electrostatic latent image is formed on each surface thereof by the exposure unit 30, are provided, respectively. As illustrated in FIG. 1, an embodiment of the photosensitive mediums 41K, 41Y, 41M, and 41C is installed at the developers 40K, 40Y, 40M, and 40C, respectively, but the photosensitive mediums 41K, 41Y, 41M, and 41C may be installed at inside the body 10, separately from the developers 40K, 40Y, 40M, and 40C. The photosensitive mediums 41 may be the photosensitive drum 41 provided with a photoelectric layer formed on an outer circumferential surface of a metallic drum having a cylindrical shape.

Each of the developers 40K, 40Y, 40M, and 40C may be provided with a toner storage unit 42 in which toner is stored, a charging roller 43 to charge a corresponding one of the photosensitive mediums 41K, 41Y, 41M, and 41C, a developing roller 44 to develop the electrostatic latent image formed at each of the photosensitive mediums 41K, 41Y, 41M, and 41C into a toner image, and a supplying roller 45 to supply toner to the developing roller 44. The toners may be of different colors other than the black 'K', the yellow 'Y', the magenta 'M', and the cyan 'C', but in the exemplary embodiments only the black 'K', the yellow 'Y', the magenta 'M', and the cyan 'C' will be described, as an example.

The intermediate transfer unit 50 may be configured as an intermediate medium to transfer the toner image developed on the outer circumferential surface of each of the photosensitive mediums 41K, 41Y, 41M, and 41C onto the paper 'P'. The intermediate transfer unit 50 includes a intermediate transfer belt 51 to run in a circulated manner by being in contact with each of the photosensitive mediums 41K, 41Y, 41M, and 41C, a driving roller 52 to drive the intermediate transfer belt 51, a supporting roller 53 to maintain the tension of the intermediate transfer belt 51, and four units of intermediate transfer roller 54 to transfer the toner image developed on the outer circumferential surface of each of the photosensitive mediums 41K, 41Y, 41M, and 41C.

The transferring unit 90 transfers the toner image developed on the intermediate transfer belt 51 to the paper 'P' by making contact with one surface of the intermediate transfer belt 51 such that the paper 'P' passes through in between the transferring unit 90 and the one surface of the intermediate transfer belt 51. The transferring unit 90 includes a transferring roller that rotates while in contact with the one surface of the intermediate transfer belt 51, and a driving unit to drive the transferring roller.

The fixing unit 60 may be configured to fix the toner image to the paper 'P' by applying heat and pressure to the paper 'P'. The fixing unit 60 includes a heating roller 61 having a heat source to apply heat to the paper 'P' having the toner transferred, and a pressing roller 62 disposed opposite to the heating roller 61 to have a constant amount of fixing pressure maintained in between the heating roller 61 and the pressing roller 62.

The paper discharging unit 70 may be configured to discharge the paper 'P' having the printing completed to an outside the body 10, and includes a paper discharging roller 71 and a back-up roller 72 that rotates together with the paper discharging roller 71.

The pattern detecting unit 80 may be configured to detect the transfer position of the toner of the ACR pattern that is printed on the intermediate transfer belt 51 to perform the color registration task. L light emitting unit may be configured to emit light toward the intermediate transfer belt 51 positioned at a front in the X-axis direction. A light sensor is provided having a light receiving unit that receives the light reflected at the intermediate transfer belt 51, and by collecting the light being returned after reflected from the toner layer of the ACR pattern (an offset-calibration pattern of each color) printed on the intermediate transfer belt 51, the transfer position of the toner of the ACR pattern may be recognized.

With respect to recognizing the transfer position of the toner of the ACR pattern, an end portion of one side and an end portion of the other side in the width direction of the color image may have different color registrations from each other by the scanning skew of the exposure units 30K, 30Y, 30M, and 30C. Thus, a light sensor may be provided at each end portion of the both sides of the intermediate transfer belt 51. However, an embodiment of the present disclosure is not limited to such a light sensor, and any sensing apparatus capable of detecting the pattern that is formed on the surface of the intermediate transfer belt 51 may be applied.

Figure 2:
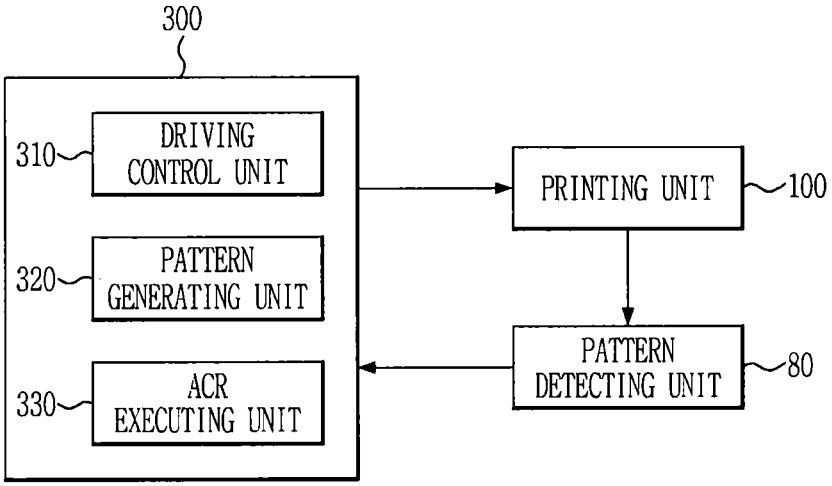
FIG. 2 illustrates an image forming apparatus in accordance with an embodiment of the present disclosure.

FIG. 2 illustrates an image forming apparatus in accordance with an embodiment of the present disclosure. Referring to FIGS. 1 to 2, an exemplary operation of the image forming apparatus in accordance with an embodiment of the present disclosure will be described in detail.

Referring to FIG. 2, the image forming apparatus in accordance with an embodiment of the present disclosure includes a control unit 300 to control the printing operation and the ACR task of the image forming apparatus, a printing unit 100 to perform the printing operation, and the pattern detecting unit 80 to detect a pattern that is formed on the surface of the intermediate transfer belt 51.

The printing unit 100 includes the exposure unit 30, the developing unit 40, the intermediate transfer unit 50, and the transferring unit 90.

The control unit 300 includes a driving control unit 310 to control the driving of each unit included in the printing unit 100, a pattern generating unit 320 configured to have the exposure unit 30 to form an electrostatic latent image, which corresponds to an ACR pattern, on the photosensitive medium 41, and an ACR executing unit 330 to calibrate an error by calculating a DC offset between colors to execute an ACR task.

The pattern generating unit 320 may be configured to generate the ACR pattern that is formed on the surface of the intermediate transfer belt 51 to execute the ACR task. To execute the ACR task, an image signal that corresponds to the ACR pattern may be transmitted to the exposure unit of each color. For the convenience of the description, the A transmitting of the image signal that corresponds to the ACR pattern to the exposure unit 30 from the pattern generating unit 320 will be referred to as "the generating of the ACR pattern".

The exposure unit 30 of each color forms the electrostatic latent image, which corresponds to the transmitted image signal, on the photosensitive drum 41 of each color, and the developer of each color develops the electrostatic latent image by supplying the toner of the color that corresponding to the electrostatic latent image that is formed on the photosensitive drum 41. The developed electrostatic latent image becomes the toner image. Since the toner image is transferred to the surface of the intermediate transfer belt 51 by the contact and the rotation of the photosensitive drum 41 and the intermediate transfer belt 51, the toner image transferred to the surface of the intermediate transfer belt 51 becomes the ACR pattern of each color. The ACR pattern is formed in a similar manner by each color, and thus in the following description, the ACR pattern is referred to as an ACR corresponding to a single color.

The pattern detecting unit 80 detects the ACR pattern that is formed on the surface of the intermediate transfer belt 51, and outputs the result of the detection, so that the position of the ACR pattern may be measured. The light reflected at the ACR pattern of each color after being transmitted from the pattern detecting unit 80, is received, so that the transfer position of the toner of each color may be measured. The pattern detecting unit 80 transmits the result of the detection of the ACR pattern to an ACR executing unit 330.

The ACR executing unit 330, on the basis of the detection result of the pattern detecting unit 80, measures the position of the ACR pattern, and calculates the degree of the measured position deviated from a reference position, that is, an offset of each color. The offset of each color being calculated may be referred to as a DC offset. The ACR executing unit 330, by calibrating the DC offset being calculated, performs the color registration task.

The ACR pattern formed on the surface of the intermediate transfer belt 51 is transferred from the photosensitive drum 41 to the intermediate transfer belt 51, and thus the ACR pattern is affected by an Alternating Current (AC) component that is being generated by a periodic change of the linear speed by the rotation of the photosensitive drum 41. Since the calculated amount of the DC offset varies depending on the composition of the ACR pattern of each pattern, the pattern generating unit 320 of the image forming apparatus in accordance with an embodiment of the present disclosure makes up a ACR pattern according to particular rules, and arranges the ACR pattern at a particular interval.

A correlation between the AC component and the color registration of the photosensitive drum 41 and an exemplary operation of the photosensitive drum 41 are disclosed.

Figure 3:
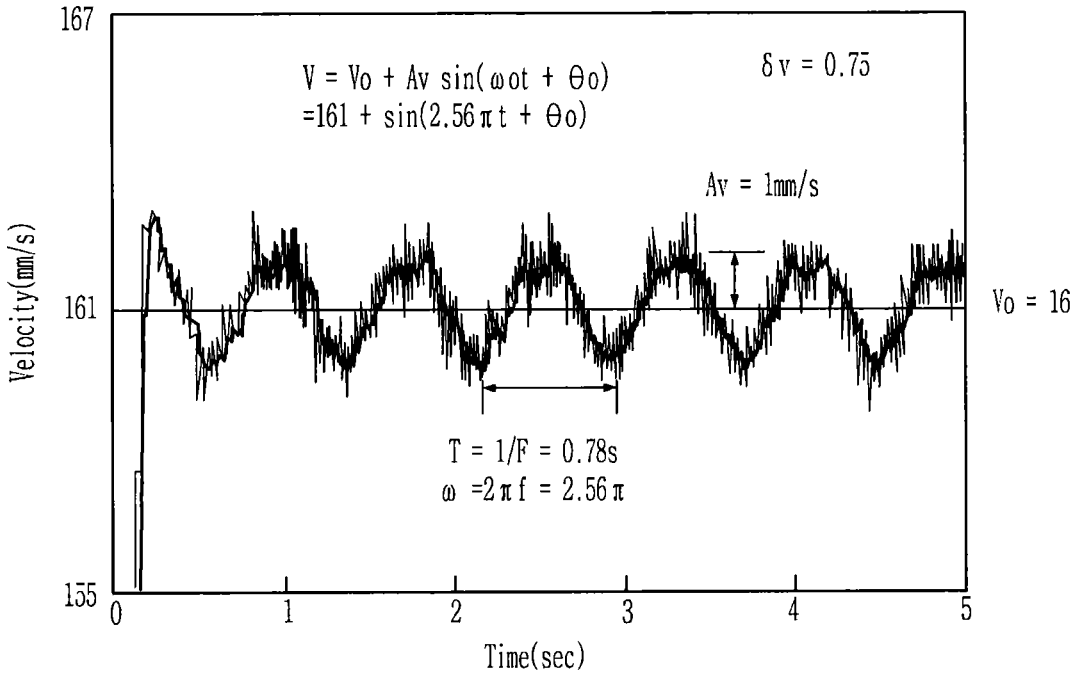
FIG. 3 is an exemplary rotation speed graph of a photosensitive drum according to time.
Figure 4:
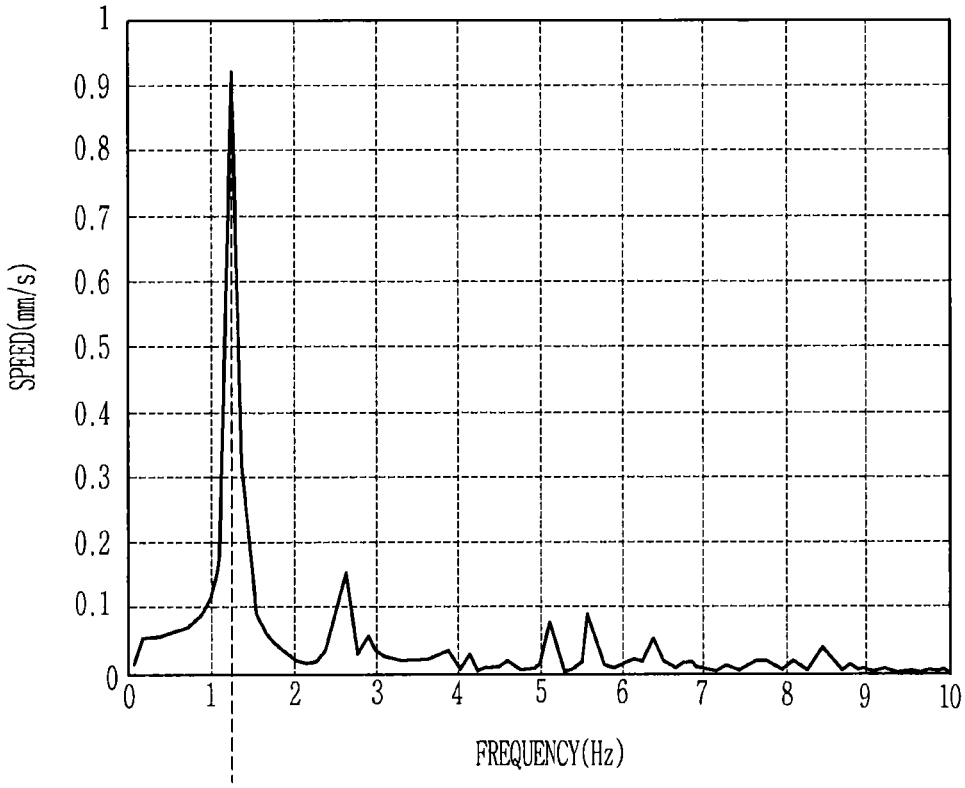
FIG. 4 is an exemplary frequency analysis graph of a rotation speed of a photosensitive drum.

FIG. 3 is an exemplary rotation speed graph of a photosensitive drum according to time. FIG. 4 is an exemplary frequency analysis graph of a rotation speed of a photosensitive drum. A magenta photosensitive drum 41 to which the toner of the magenta 'M' is supplied is used.

For a rotation speed of the photosensitive drum 41 to be about 161 mm/sec, the input signal of about 1,268.4 PPS (Pulse Per Second) is entered at the sampling time of the 0.01 sec. However, the rotation speed of the photosensitive drum 41, as illustrated on FIG. 3, is provided with an average speed component of about 161 mm/sec and an alternating current speed component (AC component) of an amplitude of about 1 mm/sec and a period of about 0.78 sec. That is, even when the driving unit is controlled in a way that the driving unit is constantly rotated at a constant speed, the speed change such as the AC component is present at the rotation speed of the photosensitive drum 41.

Referring to the frequency analysis graph on FIG. 4, the frequency at 1.28 Hz (=f) is the most dominant frequency, and 1/f corresponds to the period of the AC component.

The AC component of the photosensitive drum 41 may be approximated as a sine wave, and the rotation speed 'V' of the photosensitive drum 41 may be expressed by approximating through the [Mathematical formula 1]:

$$V=V_0+A_v\sin(w_0t+\theta_0),$$

$$V_0=161\text{ mm/sec}$$

$$A_v=1\text{ mm/sec}$$

$$w_9=2\pi 9f=2.56\pi(f=1/T)$$

$$\theta_0=\text{phase of the AC signal}$$

[Mathematical formula 1]

Figure 5A:
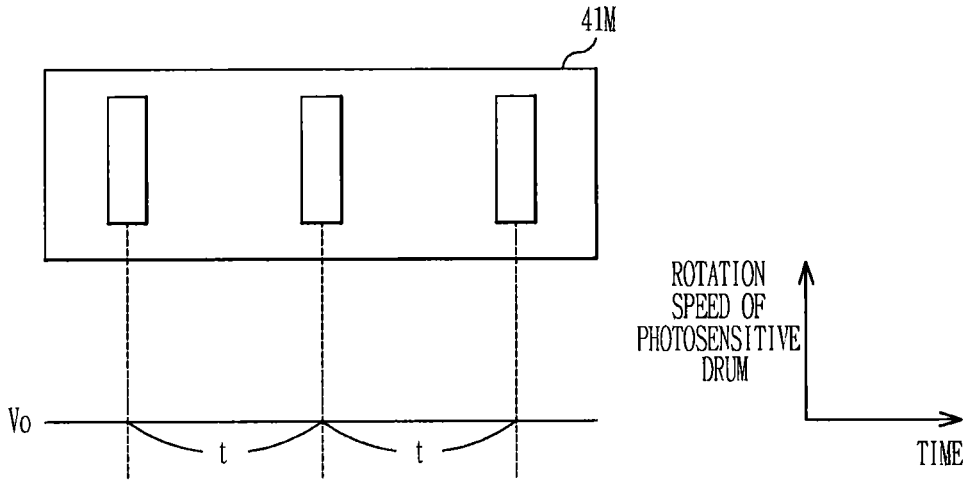
FIG. 5A illustrates a gap of an ACR pattern formed on a photosensitive drum in a case when the photosensitive drum is rotated at a constant speed.
Figure 5B:
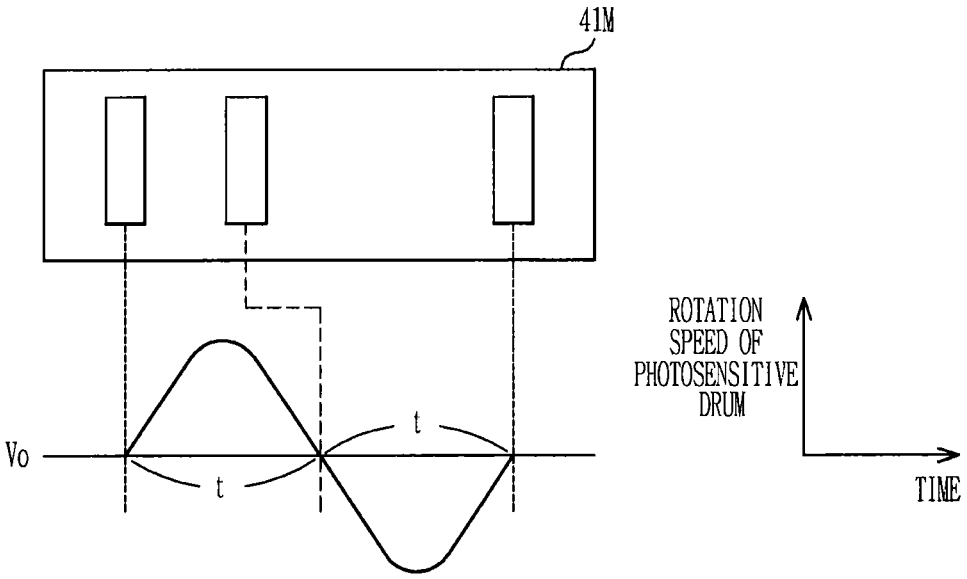
FIG. 5B illustrates a gap of an ACR pattern formed on a photosensitive drum in a case when the photosensitive drum is provided with an AC component.

FIG. 5A illustrates the gap of the ACR patterns formed on a photosensitive drum in a case when the photosensitive drum is rotated at a constant speed. FIG. 5B illustrates the gap of the ACR patterns formed on a photosensitive drum in a case when the photosensitive drum is provided with an AC component.

For example, to form electrostatic latent images of an ACR pattern including the total of three sub patterns having an equal interval therein between on the outer circumferential surface of the photosensitive drum 41, the exposure unit 30 forms the electrostatic latent image of the first sub pattern, and then the exposure unit 30 forms the remaining of the electrostatic latent images at an equal time interval 't'.

When the photosensitive drum 41 is rotated at a constant speed, as illustrated on FIG. 5*a*, the electrostatic latent images that correspond to the total of the three sub patterns are formed at the equal interval therein between.

However, even when the driving unit of the photosensitive drum 41 outputs a constant driving signal to rotate the photosensitive drum 41 at a constant speed, the photosensitive drum 41 has the AC component and repeats the increase and the decrease of the speed with respect to a reference speed. In a case when the photosensitive drum 41 is provided with the AC component as such, as illustrated on FIG. 5B, a change is made with respect to a gap between the electrostatic latent images of the sub patterns formed on the outer circumferential surface of the photosensitive drum 41.

As illustrated on FIG. 5B, by the Ac component, during the first 't' section, the actual rotation speed of the photosensitive drum 41 may be greater than the reference speed '$V_0$', and during the second 't' section, the actual rotation speed of the photosensitive drum 41 is less than the reference speed '$V_0$'. The gap between the first sub pattern and the second sub pattern may become larger than a reference gap, and the gap between the second sub pattern and the third sub pattern may become smaller than the reference gap. The reference gap may be referred to as a gap between the sub patterns when the rotation speed of the photosensitive drum 41 is at constant.

Figure 6:
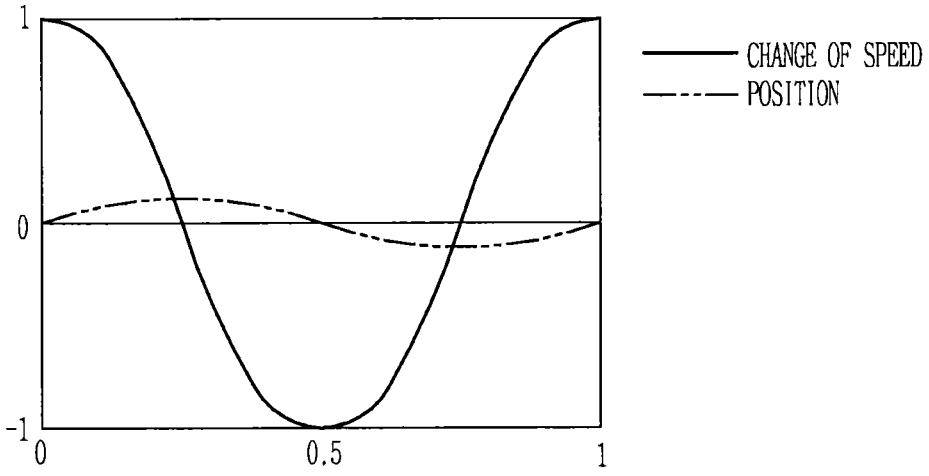
FIG. 6 illustrates a measurement of a gap change in between a plurality of sub patterns of a ACR pattern in a case when the photosensitive drum is provided with an AC component.

FIG. 6 illustrates a gap change in between a plurality of sub patterns of the ACR pattern in a case when the photosensitive drum is provided with an AC component.

As illustrated on FIG. 6, in a case when the rotation speed of the photosensitive drum 41 is changed in the form of a sine wave, the gap in between the plurality of sub patterns formed at the photosensitive drum 41 may also changed in the form of a sine wave.

If the amounts of the gap changes of the plurality of sub patterns for a single color are averaged, the result represents a value of the DC offset of the single color, and the DC offset, which is the subject of a calibration, may be calculated. The amount of the gap change of the sub pattern may be referred to as the amount of the change with respect to the reference gap. For example, an image signal that is transmitted to the exposure unit from the pattern generating unit 320 is related to an ACR pattern having an equal interval of about 100 dot, however, if the gap becomes about 101 dot by the AC component of the photosensitive drum 41, the amount of the gap change may be set at about +1, and if the gap becomes about 99 dot, then the amount of the gap change may be set at about −1.

The errors with respect to the color registration include an offset in an x-axis direction, an offset in a y-axis direction, an error in the width of a printing, and a skew. The offset value in the x-axis direction may be referred to as an error that occurs at the pattern in a main-scan direction, that is, in the direction that the sensor performs a scanning, the offset in the y-axis direction is referred to as an error that occurs at the pattern in a sub-scan direction, that is, in the direction that the transfer belt is proceeded, the error in the width of a printing is referred to as an error that occurs from the difference of the left/right width of an image area, and the skew is referred to as an error that occurs when the developing line is bent. When forming the ACR pattern, as to detect the errors as such, the composition and the arrangement of the pattern may be determined.

Figure 7:
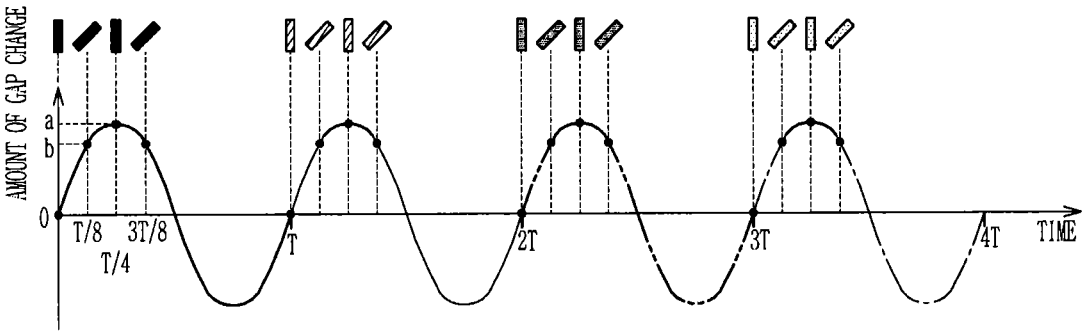
FIG. 7 illustrates an ACR pattern transferred to an intermediate transfer belt and the amount of gap change of sub patterns of the ACR pattern.

FIG. 7 illustrates the composition of ACR patterns that are transferred to an intermediate transfer belt in a conventional technology and the amounts of gap changes of the sub patterns of the ACR patterns.

As illustrated on FIG. 7, the ACR pattern includes a sub pattern having a shape of a slant to detect the error at the pattern in the main-scan direction, that is, the offset in the x-axis direction, and a sub pattern having a shape of a bar to detect the error at pattern in the sub-scan direction, that is, the offset in the y-axis direction. The sub pattern having a shape of a slant is inclined with respect to the sub pattern having a shape of a bar at a predetermined angle. The sub pattern having a shape of a bar may be referred to as a sub-scan direction pattern, and the sub pattern having a shape of a slant may be referred to as a main-scan direction pattern.

Assuming that the proceeding direction of the intermediate transfer belt 51 is the widthwise direction, the error in the width of a printing may be detected by disposing the same ACR pattern in a vertical direction.

FIG. 7 is an embodiment of the ACR pattern, and since the same ACR pattern is used for each color that is formed on the surface of the intermediate transfer belt 51, only the ACR pattern with respect to the black 'K' is described.

A photosensitive drum 41 configured to move the toner image, which is with respect to the ACR pattern, to the intermediate transfer belt 51 is provided with an AC change component that occurs by a rotation. Assuming that the time for the photosensitive drum 41 to take in making a single revolution is referred to as one cycle 'T' of the AC component, the ACR pattern on FIG. 7 includes two of the sub-scan direction patterns and two of the main-scan direction patterns within the one cycle 'T'.

Referring to FIG. 7, the first sub-scan direction pattern from the left side of the graph is provided with the amount of the gap change of about 0 at the AC component, and the second sub-scan direction pattern is provided with the amount of the gap change of a positive value, that is, +a. Thus, if the amount of the gap change the above is averaged, the representing value of the AC component of the sub-scan direction patterns among the ACR patterns with respect to the black 'K' is provided with a positive value that is greater than 0.

With respect to the first main-scan direction pattern, the amount of the gap change is a positive value, that is, +b, and with respect to the second main-scan direction pattern, the amount of the gap change is a positive value, that is, +b. Thus, the representing value of the AC component of the main-scan direction patterns among the ACR patterns with respect to the black 'K' also is provided with a positive value that is greater than 0.

Figure 8:
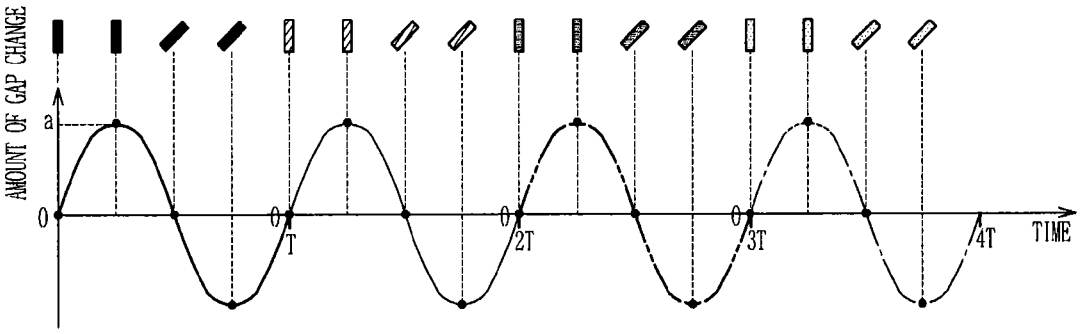
FIG. 8 illustrates an embodiment of an ACR pattern.

FIG. 8 illustrates an embodiment of the ACR pattern. On FIG. 8, only the ACR pattern with respect to the black 'K' is described.

Referring to FIG. 8, two of sub-scan direction patterns and two of main-scan direction patterns are included within one cycle 'T'. By referring to FIG. 8, the first sub-scan direction pattern from the left side of the graph is provided with the amount of the gap change of about 0, and the second sub-scan direction pattern from the left side of the graph is provided with the amount of the gap change of +a. The first main-scan direction pattern is provided with the amount of the gap change of about 0, and the second main-scan direction pattern is provided with the amount of the gap change of −a.

Thus, with respect to the ACR pattern on FIG. 8, the representing value of the AC component of the sub-scan direction patterns becomes a positive value, and the representing value of the AC component of the main-scan direction pattern becomes a negative value.

Over one cycle, the amount of the gap change by the AC component vibrates while having a value of 0, that is, the reference gap, a center of vibration, and consequently, the central value or the representing value becomes about 0. As illustrated in FIGS. 7 to 8, when the representing value of the AC component of the ACR pattern is calculated as a positive value or a negative value, instead of 0, the DC offset error value of each color may not be accurately determined. Thus, the image forming apparatus in accordance with an aspect of the present disclosure, by controlling the arrangement and the composition of the ACR pattern, enables the average value of the amounts of the gap changes of the sub patterns, which form the ACR patterns by each color, to be about 0.

With digital signal processing, the position of each ACR pattern being transferred to the intermediate transfer belt 51 may be sampled in a form of 'n' number of discrete values through the pattern detecting unit. When an AC component of the photosensitive drum 41 is present, if more than two sub patterns are disposed at the cycle of the AC component, and the sampling frequency becomes greater than twice of the change of AC component of the photosensitive drum 41, thereby able to prevent an aliasing, the AC component of the photosensitive drum 41 may be able to be determined.

Thus, if more than two sub patterns are present at the cycle of the AC component of the photosensitive drum 41 and if the patterns are disposed determinable by considering the cycle of the AC component of the photosensitive drum 41, an accurate representing value of the AC component may be attained. Even when the AC component of the photosensitive drum 41 is present, an accurate DC offset value of each color may be calculated.

With respect to the image forming apparatus in accordance with an aspect of the present disclosure, the pattern generating unit 320 forms the ACR pattern including more than two sub patterns such that the average value of the amounts of the gap changes by the AC component of the photosensitive drum 41 becomes about 0. That is, each of the AC components representing a value of the sub-scan direction patterns and the AC component representing value of the main-scan direction patterns become about 0.

According to an exemplary embodiment an average value of the amounts of the gap changes by the AC component may become about 0 and the following rules may be presented.

Rule i) Assuming that the diameter of the photosensitive drum 41 is referred to as 'D', the length that the ACR pattern of respective colors occupies becomes $\pi D \times N (N \geq 1)$. Thus, the length 'L' of the entire ACR pattern becomes $\pi D \times 4N$ ($N \geq 1$). The ACR pattern of each color includes the sub-scan direction pattern having a bar shape and the main-scan direction pattern having a slant shape that serve as the sub pattern of the ACR pattern, and the gap in between each sub pattern is provided with the following rules. Since purposes of the sub-scan direction pattern and the main-scan direction pattern are different, the sub-scan direction pattern and the main-scan direction pattern have different shapes from each other.

With respect to the ACR pattern of each color, the sub-scan direction patterns may be provided in the same number as the main-scan direction patterns within the cycle of the AC component of the photosensitive drum 41 (M, $M \geq 2$), Rule ii) a pattern adjacent to a random pattern on an $M^{th}$ order, that is, the $M^{th}$ adjacent pattern has the same shape as the random pattern, and Rule iii) the gap between the random pattern and the $M^{th}$ adjacent pattern to the random pattern is needed to be $\pi D/2$.

Hereinafter, by referring to the drawing, the embodiment that satisfies the above rules will be described in detail.

Figure 9:
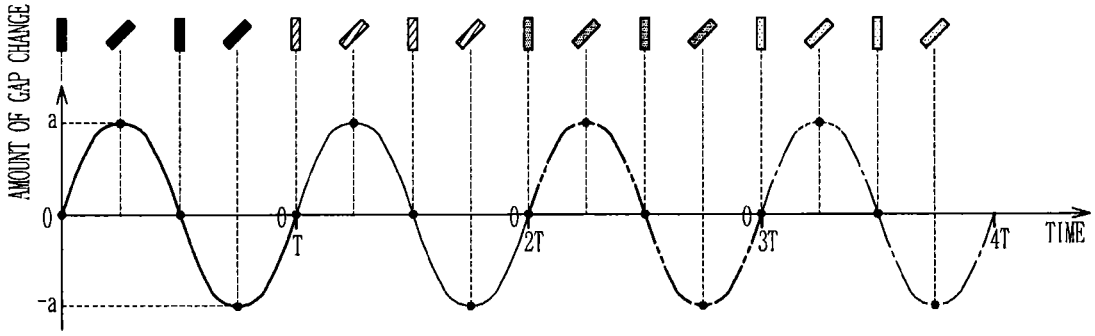
FIG. 9 illustrates a gap change of an ACR pattern formed in accordance with an embodiment of the present disclosure.

FIG. 9 illustrates the composition and the amount of gap change of the ACR pattern formed in accordance with an embodiment of the present disclosure. Since the composition of the ACR pattern of each color is same with that of other colors, only the ACR pattern of the black 'K' will be described.

Referring to FIG. 9, the ACR pattern in the present embodiment includes two sub-scan direction patterns and two main-scan direction patterns (satisfies rule i), and a pattern set as a second adjacent pattern to a random pattern has the same shape as the random pattern among the four sub patterns (satisfies rule ii). In addition, from the total of the four patterns, the gap between a random pattern and the second adjacent to the random pattern among the four sub patterns is about $\pi D/2$ (satisfies the rule iii).

The pattern generating unit 320, in order to form electrostatic latent images, which are with respect to the total of the four patterns, on the photosensitive drum 41 at an equal time interval, transmits a signal to the exposure unit 30, and for example, the exposure unit 30 forms an electrostatic latent image of a first sub-scan direction pattern at the time 0, an electrostatic latent image of a first main-scan direction pattern at the time T/4, an electrostatic latent image of a second sub-scan direction pattern at the time T/2, and an electrostatic latent image of a second main-scan direction pattern at the time 3T/4.

Even when an electrostatic latent image is formed at the equal time interval, the gap between each sub pattern is changed by the AC component of the photosensitive drum 41. By referring to FIG. 9, the amount of the gap change of the first sub-scan direction pattern is about 0, and the amount of the gap change of the second sub-scan direction pattern is also about 0. Thus, the representing value of the sub-scan direction patterns is about 0.

The amount of the gap change of the first main-scan direction pattern is +a, the amount of the gap change of the second main-scan direction pattern is −a, and thus the representing value of the main-scan direction patterns is also about 0.

Figure 10:
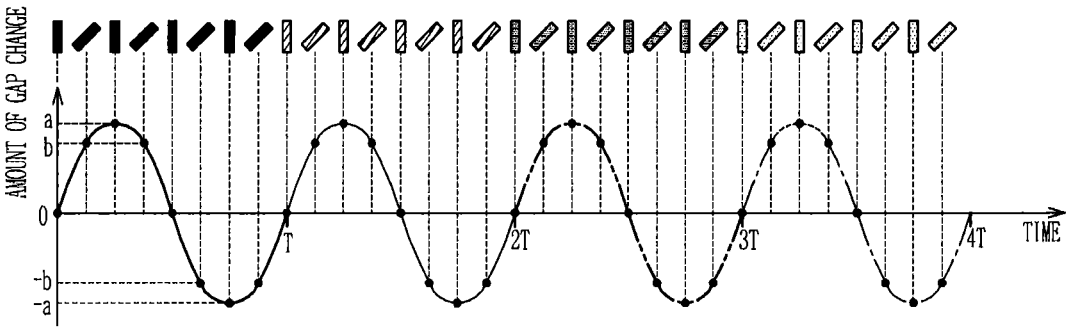
FIG. 10 illustrates a gap change of an ACR pattern formed in accordance with an embodiment of the present disclosure.

FIG. 10 illustrates the composition and the amount of gap change of the ACR pattern formed in accordance with an embodiment of the present disclosure. As same as on FIG. 9, only the ACR pattern of the black 'K' will be described.

By referring to FIG. 10, the ACR pattern in the present embodiment includes eight sub patterns, and the eight patterns include four sub-scan direction patterns and four main-scan direction patterns (satisfies rule i), and a pattern set as a fourth adjacent pattern to a random pattern among has the same shape as the random pattern (satisfies the rule ii). As two examples, with respect to the ACR pattern on FIG. 10, a pattern set as an a fourth adjacent pattern to the first main-scan direction pattern corresponds to a main-scan direction pattern, and a pattern set as a fourth adjacent pattern to the second sub-scan direction pattern corresponds to a sub-scan direction pattern. In addition, the gap between the first main-scan direction pattern and the fourth adjacent pattern to the first main-scan direction pattern is about $\pi D/2$, and the gap between the second sub-scan direction pattern and the fourth adjacent pattern to the second sub-scan direction pattern is about $\pi D/2$ (satisfies the rule iii).

Since the eight sub patterns on FIG. 10 are formed at the equal time interval, the first sub-scan direction pattern is formed at the time 0, the first main-scan direction pattern is formed at the time T/8, the second sub-scan direction pattern is formed at the time T/4, the second main-scan direction pattern is formed at the time 3T/8, the third sub-scan direction pattern is formed at the time T/2, the third main-scan direction pattern is formed at the time 5T/8, the fourth sub-scan direction pattern is formed at the time 3T/4, and the fourth main-scan direction pattern i is formed at the time 7T/8.

By referring to the graph on FIG. 10, the amount of the gap change of the first sub-scan direction pattern is about 0, the amount of the gap change of the second sub-scan direction pattern is +a, and the amount of the gap change of the third sub-scan direction pattern is −a. Thus, the representing value of the sub-scan direction patterns is about 0.

The amount of the gap change of the first main-scan direction pattern is +b, the amount of the gap change of the second main-scan direction pattern is +b, the amount of the gap change of the third main-scan direction pattern is −b, and the amount of the gap change of the fourth main-scan direction pattern is −b. Thus the representing value of the main-scan direction patterns is also about 0.

Figure 11:
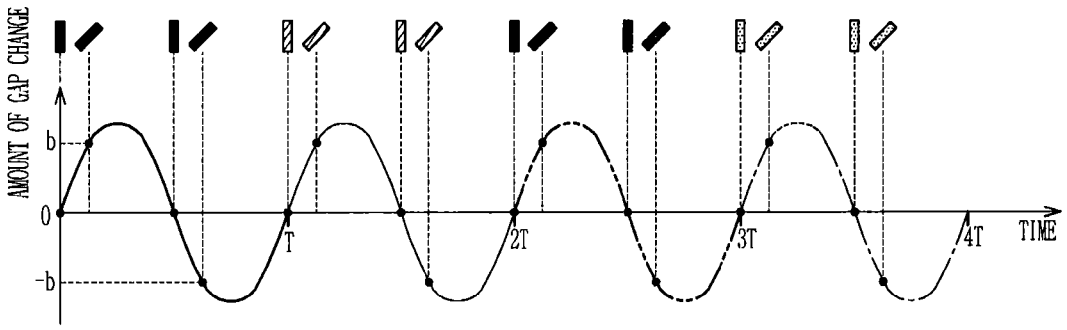
FIG. 11 illustrates a gap change of an ACR pattern formed in accordance with still an embodiment of the present disclosure.

FIG. 11 illustrates the composition and the amount of the gap change of the ACR pattern formed in accordance with still an embodiment of the present disclosure. As same as on FIG. 9, only the ACR pattern of the black 'K' will be described.

By referring to FIG. 11, the ACR pattern includes four sub patterns, and the four sub patterns include two sub-scan direction patterns and two main-scan direction patterns (satisfies rule i). In addition, a pattern set as a second adjacent pattern to a random pattern among the four sub pattern has the same shape as the random pattern (satisfies rule ii), and the gap between the random pattern and the second adjacent pattern to the random pattern is about $\pi D/2$ (satisfies rule iii).

Each sub pattern in accordance with the embodiment of the present disclosure is not formed at an equal time interval, and the first sub-scan direction pattern is formed at the time 0, the second sub-scan direction pattern is formed at the time T/2, the first main-scan direction pattern is formed at the time T/8, and the second main-scan direction pattern is formed at the time 5T/8.

By referring to the drawing on FIG. 11, the amount of the gap change of the first sub-scan direction pattern is about 0, and the amount of the gap change of the second sub-scan direction pattern is also about 0. Thus, the representing value of the sub-scan direction patterns is about 0. The amount of the gap change of the first main-scan direction pattern is +b, the amount of the gap change of the second main-scan direction pattern is −b, and thus the representing value of the main-scan direction patterns is about 0.

Figure 12:
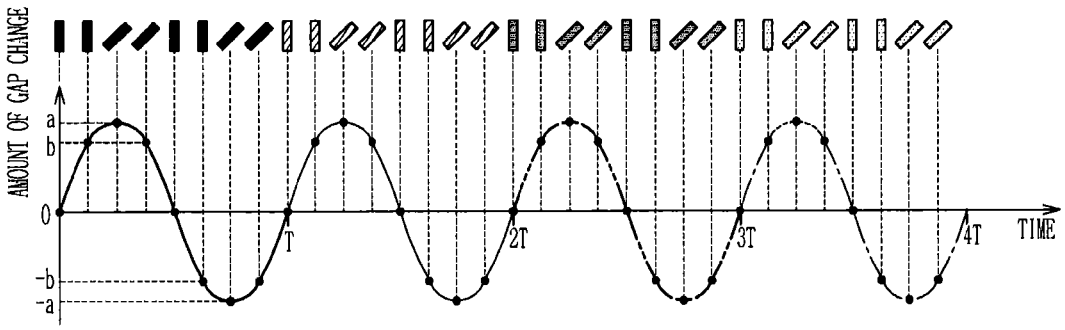
FIG. 12 illustrates a gap change of an ACR pattern formed in accordance with still an embodiment of the present disclosure.

FIG. 12 illustrates the composition and the amount of the gap change of the ACR pattern formed in accordance with still an embodiment of the present disclosure.

By referring to FIG. 12, the ACR pattern includes eight sub patterns, and the eight sub patterns include four sub-scan direction patterns and four main-scan direction patterns (satisfies rule i). In addition, a pattern set as a fourth adjacent pattern to a random pattern among the four sub patterns has the same shape as the random pattern (satisfies rule ii), and the gap between the random pattern and the fourth adjacent pattern to the random pattern is about $\pi D/2$ (satisfies rule iii).

On FIG. 12, the sub patterns of the ACR patterns are formed at an equal time interval, but differently from the earlier embodiments, the sub-scan direction pattern and the main-scan direction pattern are not alternately positioned. The first sub-scan direction pattern is formed at the time 0, the second sub-scan direction pattern is formed at the time T/8, the third sub-scan direction pattern is formed at the time T/2, the fourth sub-scan direction pattern is formed at the time 5T/8, the first main-scan direction pattern is formed at the time T/4, the second main-scan direction pattern is formed at the time 3T/8, the third main-scan direction pattern is formed at the time 3T/4, and the fourth main-scan direction pattern is formed at the time 7T/8.

By referring to the graph on FIG. 12, the amount of the gap change of the first sub-scan direction pattern is about 0, the amount of the gap change of the second sub-scan direction pattern is +b, the amount of the gap change of the third sub-scan direction pattern is about 0, and the amount of the gap change of the fourth sub-scan direction pattern is −b. Thus, the representing value of the sub-scan direction patterns is about 0.

The amount of the gap change of the first main-scan direction pattern is +a, the amount of the gap change of the second main-scan direction pattern is +b, the amount of the gap change of the third main-scan direction pattern is −a, and the amount of the gap change of the fourth main-scan direction pattern is −b. Thus, the representing value of the main-scan direction patterns is also about 0.

As same as the embodiments illustrated on FIGS. 9 to 12, when the representing value of the AC component of the sub-scan direction patterns and the representing value of the AC component of the main-scan direction patterns each become about 0, even in a case when the AC component of the photosensitive drum 41 is present, the accurate DC offset error may be predicted, and thereby the ACR task may be effectively performed.

The pattern generating unit 320 may store more than one ACR pattern having the representing value of the AC component at about 0, and transmits an image signal that corresponds to the stored ACR pattern to the exposure unit 30. However, the embodiment of the present disclosure is not limited hereto, and an image signal that corresponds to an ACR pattern may be randomly generated according to the rules described earlier.

In addition, an ACR pattern being generated at the pattern generating unit 320 is not limited to the embodiments of FIGS. 9 to 12, and any ACR pattern that is provided with the representing value of the AC component at about 0 or that satisfies the rules described earlier may be included.

Hereinafter, a method of controlling an image forming apparatus in accordance with one aspect of the present disclosure will be briefly described.

Figure 13:
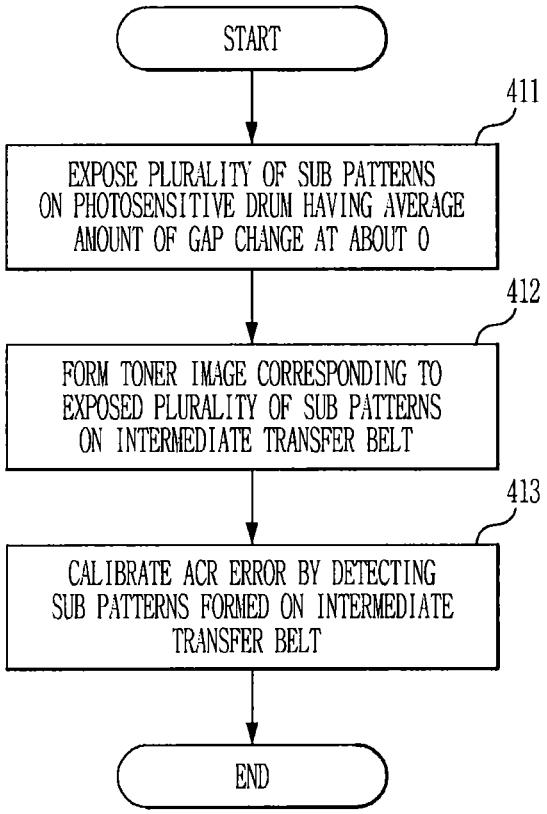
FIG. 13 illustrates a control method of an image forming apparatus in accordance with an embodiment of the present disclosure.

FIG. 13 illustrates a control method of an image forming apparatus in accordance with an embodiment of the present disclosure.

Referring to FIG. 13, first, from the pattern generating unit 320, an image signal corresponding to an ACR pattern is transmitted to the exposure unit 30, and the ACR pattern having the average amount of the gap change of the sub patterns is exposed at the photosensitive drum 41 (411). Through such, an electrostatic latent image that corresponds to the ACR pattern is formed at the photosensitive drum 41, and here, the ACR pattern may be provided with the average value of the amounts of the gap changes of the sub patterns at about 0, and more particularly, the ACR pattern may be the pattern that satisfies the rules that are described earlier.

A toner image corresponding to the ACR pattern, which is exposed at the photosensitive drum 41, is formed at the surface of the intermediate transfer belt 51 (412). The developer of each color supplies a toner to the electrostatic latent image formed at the photosensitive drum 41 to form the toner image, and as the photosensitive drum 41 and the intermediate transfer belt 51 are rotated while being in a contact state to each other, the toner image is transferred to the intermediate transfer belt 51, and thereby the toner image is formed on the surface of the intermediate transfer belt 51.

As the pattern detecting unit detects the ACR pattern formed on the intermediate transfer belt 51 and as the result of detection is transmitted to the ACR executing unit, the ACR executing unit, by calibrating the ACR error on the basis of the result transmitted, performs the ACR task (413).

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus of a single pass scheme comprising a photosensitive drum having an outer circumferential surface on which an electrostatic latent image is formed, an exposure unit configured to radiate light at the photosensitive drum to form the electrostatic latent image on the outer circumferential surface of the photosensitive drum, a developing unit configured to form a toner image by supplying a color toner that corresponds to the electrostatic latent image formed on the outer circumferential surface of the photosensitive drum, and an intermediate transfer belt to which the toner image formed at the outer circumferential surface of the photosensitive drum is transferred, the image forming apparatus comprising:

a pattern generating unit configured to form an electrostatic latent image corresponding to a predetermined ACR (Auto Color Registration) pattern on the outer circumferential surface of the photosensitive drum to form the ACR pattern on the intermediate transfer belt, the pattern generating unit allowing amounts of gap changes of a plurality of sub patterns, which forms the ACR pattern, to have an average value of about 0, the gap change of the plurality of sub patterns caused by an AC component generated from a rotation of the photosensitive drum;

a pattern detecting unit configured to detect the ACR pattern that is formed on the intermediate transfer belt; and an ACR executing unit configured to calculate an offset of each color based on the detection result of the pattern detecting unit, and to correct a color registration error by use of the offset calculated.

2. The image forming apparatus of claim 1, wherein:

the pattern generating unit is configured in a way that the plurality of sub patterns forming the ACR pattern comprises main-scan direction patterns and sub-scan direction patterns that are provided in different forms from the main-scan direction patterns, and the pattern generating unit is configured to allow an average value of amounts of gap changes of the main-scan direction patterns and an average value of amounts of gap changes of the sub-scan direction patterns to be about 0.

3. The image forming apparatus of claim 2, wherein:

the pattern generating unit allows the ACR pattern to have a length that is an integer multiple of a circumferential length of the photosensitive drum.

4. The image forming apparatus of claim 3, wherein:

the pattern generating unit allows the main-scan direction patterns to be generated in a same number as the sub-scan direction patterns, the number being an integer equal to or larger than two.

5. The image forming apparatus of claim 4, wherein:

the pattern generating unit allows a pattern adjacent to a random pattern on an $M^{th}$ order in the ACR pattern to have a same shape as the random pattern.

6. The image forming apparatus of claim 5, wherein:

the pattern generating unit allows a gap between the random pattern and the pattern adjacent to the random pattern on the $M^{th}$ order to be half the circumferential length of the photosensitive drum.

7. The image forming apparatus of claim 6, wherein:

the pattern generating unit allows the sub-scan direction pattern to have a bar shape while allowing the main-scan direction pattern to have a slant pattern that is inclined with respect to the sub-scan direction pattern at a predetermined angle.

8. The image forming apparatus of claim 7, wherein:

the predetermined angle is greater than 0 degrees and less than 90 degrees.

9. An image forming apparatus of a single pass scheme configured to form an ACR (Auto Color Registration) pattern, wherein:

the ACR pattern comprises main-scan direction patterns and sub-scan direction patterns, which are provided in different shapes from the main-scan direction patterns while provided in a same number as the main-scan direction patterns, within a period of an AC component of a photosensitive drum of the image forming apparatus, the number being an integer equal to or larger than two;

a pattern adjacent to a random pattern on an $M^{th}$ order in the ACR pattern has a same shape as the random pattern; and a gap between the random pattern and the pattern adjacent to the random pattern on the $M^{th}$ order is half a circumferential length of the photosensitive drum.

10. A method to form an ACR (Auto Color Registration) pattern on an intermediate transfer belt by an image forming apparatus, comprising controlling the image forming apparatus to calculate a color offset by detecting the ACR pattern; and executing a color registration task based on the color offset calculated, wherein:

the ACR pattern comprises a plurality of sub patterns, and the controlling comprises controlling an arrangement and a composition of the ACR pattern so that an average value of amounts of gap changes of the plurality of sub patterns caused by an AC component generated from a rotation of a photosensitive drum is about 0, wherein the plurality of sub patterns forming the ACR pattern comprises main-scan direction patterns and sub-scan direction patterns provided in different forms from the main-scan direction patterns; and an average value of amounts of gap changes the main-scan direction patterns and an average value of amounts of gap changes of the sub-scan direction patterns is about 0.

11. The method of claim 10, wherein:

the main-scan direction patterns are provided in a same number as the sub-scan direction patterns within a period of the AC component, the number being an integer equal to or larger than two.

12. The method of claim 11, wherein:

a pattern adjacent to a random pattern on an $M^{th}$ order in the ACR pattern has a same shape as the random pattern.

13. The method of claim 12, wherein:

a gap between the random pattern and the pattern adjacent to random pattern on the $M^{th}$ order is half a circumferential length of the photosensitive drum.

14. An image forming apparatus comprising:

a pattern generating unit configured to form a latent image corresponding to a predetermined ACR (Auto Color Registration) pattern on a surface of a photosensitive drum to form the ACR pattern on a transfer belt, the pattern generating unit controlling an average value of amounts of gap changes of a plurality of sub patterns, which form the ACR pattern, the gap change of the plurality of sub patterns caused by an AC component generated from a rotation of the photosensitive drum;

a pattern detecting unit configured to detect the ACR pattern that is formed on the transfer belt; and an ACR executing unit configured to calculate a color offset based on the detection result of the pattern detecting unit, and to correct a color registration error based on the offset calculated.

* * * * *